US006498564B2

(12) United States Patent
Oda

(10) Patent No.: US 6,498,564 B2
(45) Date of Patent: Dec. 24, 2002

(54) TRACKING AND MONITORING SYSTEM

(75) Inventor: Naoki Oda, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/736,109

(22) Filed: Dec. 13, 2000

(65) Prior Publication Data

US 2001/0006367 A1 Jul. 5, 2001

(30) Foreign Application Priority Data

Dec. 27, 1999 (JP) ..... 11-370590

(51) Int. Cl.[7] ..... G08B 13/18

(52) U.S. Cl. ..... 340/567; 340/545.3; 340/565; 348/152

(58) Field of Search ..... 340/541, 549, 340/545.3, 551, 555, 556, 561, 565, 567; 348/151, 152, 153, 154, 155, 169

(56) References Cited

U.S. PATENT DOCUMENTS 4,945,367 A * 7/1990 Blackshear ..... 354/81
5,299,971 A * 4/1994 Hart ..... 446/484
5,448,320 A * 9/1995 Sakai et al. ..... 354/81
5,473,368 A * 12/1995 Hart ..... 348/155
5,969,755 A * 10/1999 Courtney ..... 348/143
6,061,014 A * 5/2000 Rautanen et al. ..... 342/52
6,137,407 A * 10/2000 Akagawa et al. ..... 340/552
6,215,519 B1 * 4/2001 Nayar et al. ..... 348/159

FOREIGN PATENT DOCUMENTS

| | | | |
|---|---|---|---|
| JP | 5-240938 | | 9/1993 |
| JP | 05-240938 | * | 9/1993 |
| JP | 11-234653 | | 8/1999 |
| JP | 11-258043 | | 9/1999 |

* cited by examiner

*Primary Examiner*—Toan Pham
(74) *Attorney, Agent, or Firm*—Choate, Hall & Stewart

(57) ABSTRACT

A tracking and monitoring system directs an infrared sensor toward a heat source such as a human body, and three-dimensionally tracks the heat source, wherein the infrared sensor has four infrared detecting elements appropriately located with respect to a reference point in the field of view for producing respective detecting signals varied in magnitude depending upon the parts of the image of heat source incident on the four infrared detecting elements so that a wired logic circuit controls the attitude of the infrared sensor in such a manner as catch the image of the heat source at the reference point.

21 Claims, 12 Drawing Sheets

TRACKING AND MONITORING SYSTEM

FIELD OF THE INVENTION

This invention relates to a tracking and monitoring system and, more particularly, to a tracking and monitoring system equipped with heat source tracker used for a penetrating object.

DESCRIPTION OF THE RELATED ART

The prior art monitoring system has a human body detecting sensor or a magnet switch. When the human body detecting sensor or the magnet switch founds an invader, the sensor or the switch supplies a detecting signal to a monitor camera, and the monitor camera is directed to the invader. The monitor camera continuously or intermittently takes a moving picture, and stores the image of the invader in magnetic tape or a magnetic disk. The monitor camera may take static pictures at intervals. The images of the static pictures are stored in a photographic film.

When an inspector wants to check the images stored in the magnetic tape or the magnetic disk, the inspector instructs the controller to drive the magnetic tape or the magnetic disk for heading each of the frames, and searches the series of frames for an image to be required. However, a lot of frames are incorporated in the moving picture, and the inspector consumes a large amount of time and labor.

On the other hand, the static pictures are usually less than the frames of the moving picture, and the search is less time-consuming. Moreover, a silver film is usually used as the photographic film, and the image is clearer than those in the frames. However, the image is produced through the development, and the inspector can not promptly search an image to be required.

Another prior art monitoring system is equipped with an electronic still camera. The electronic still camera has a semiconductor memory for storing the images, and pieces of video data representative of the images are supplied from the semiconductor memory to an image reproducing apparatus. An inspector easily searches the semiconductor memory for the image to be required. However, several seconds are consumed for writing a piece of video data information. This is because of the fact that the semiconductor memory is of the type electrically writable non-volatile memory such as an EEPROM (Electrically Erasable and Programmable Read Only Memory). If an invader passes the detectable area within a short time, the prior art monitoring system merely takes several pictures, and an inspector can not clearly discriminate the invader.

Japanese Patent Publication of Unexamined Application No. 11-234653 discloses a monitoring system, which determines the traveling speed of an invader for regulating the recording intervals. The prior art monitoring system is described in detail with reference to the drawings.

FIG. 1 illustrates the first prior art monitoring system. The prior art monitoring system comprises a monitor camera 101 for taking pictures of an invader, a recording unit 102 for storing pieces of video data representative of images of the invader, a velocity sensor 103 for determining the traveling speed of the invader in the field angle θ and a camera controller 109 for controlling the intervals of photographing work. The monitor camera is corresponding to an image pick-up section of the electronic still camera, and a CCD (Charge Coupled Device) is used in the image pick-up section. The monitor camera 101 is directed to the monitoring area, and does not change the direction. However, the field angle covers the monitoring area.

The velocity sensor 103 includes an object detecting sensor 104 and a mode changer 105. The object detecting sensor 104 detects infrared light radiated from a source of heat such as a human body, and produces an object detecting signal S1. The object detecting sensor 104 supplies the object detecting signal S1 to the mode changer 105. The mode changer 105 determines the source of heat to move at a high-speed or a low-speed on the basis of the object detecting signal S1, and selectively supplies mode signals S2 and S3 to the camera controller 109. The camera controller 109 is responsive to the mode signal S2 or S3, and requests the monitor camera 101 to take pictures at high speed or a low speed. The video data are supplied from the monitor camera 101 to the recording unit 102, and are stored in the recording unit 102.

The object detecting sensor 104 has a differential infrared detector 106, an optical element 107 and a signal processing unit 108. The differential infrared detector 106 produces detecting signals at intervals, and the signal processing unit 108 produces the object detecting signal S1 from the detecting signals.

The differential infrared detector 106 is implemented by a pair of pyroelectric infrared detecting elements 106*a*/106*b*, and the pyroelectric infrared detecting elements 106*a* and 106*b* are connected in such a manner as to be opposite in polarity. For this reason, the pyroelectric infrared detecting elements 106*a*/106*b* serve as the differential infrared detector 106. The optical element 107 is implemented by a Fresnel lens, and the Fresnel lens 107 directs incident light from the detecting areas E1, E2, E3, E4 and E5 to the pyroelectric infrared detecting elements 106*a*/106*b*. Thus, the Fresnel lens 107 makes the monitor camera 101 have a coverage as wide as the monitoring area.

The detecting areas E1 to E5 are spaced from one another, and the optical element 107 assigns all of the detecting areas E1 to E5 to the object detecting sensor 104. Each of the detecting areas E1 to E5 contains two sub-areas e1 and e2, and the sub-areas e1 and e2 are assigned to the pyroelectric infrared detecting elements 106*a*/106*b*, respectively. When a heat source is in the sub-areas e1, the pyroelectric infrared detecting element 106*a* produces a detecting signal, and supplies the detecting signal to the signal processing unit 108. On the other hand, when the heat source is in the sub-areas e2, the pyroelectric infrared detecting element 106*b* produces a detecting signal, and supplies the detecting signal to the signal processing unit 108. The detecting signal from the pyroelectric infrared detecting element 106*a* is opposite in polarity to the detecting signal from the other pyroelectric infrared detecting element 106*b*.

The signal processing unit 108 includes a signal processing circuit, an amplifier, a reference level generator and a level detector. The differential infrared detector 106 is connected to the signal processing circuit, and supplies the detecting signals to the signal processing circuit. The signal processing circuit is connected to the amplifier, and the detecting signals are amplified by the amplifier. The reference level generator produces a pair of reference signals, and the pair of reference signals is indicative of a positive threshold level and a negative threshold level. The amplifier and the reference level generator are connected to the level detector, and the level detector compares the detecting signals with the reference signal. When the detecting signals exceed the threshold level, the level detector changes the object detecting signal S1 to an active high level, and keeps the detecting signals at the threshold levels in so far as the detecting signals exceed the threshold levels. Thus, the level detector produces the object detecting signal S1 from the detecting signals indicative of the source of infrared light.

Assuming now that a human body walks in the monitoring field as indicated by arrow M, the human body radiates infrared light, and crosses the detecting areas E1 to E5. While the human body is crossing each of the detecting areas E1 to E5, the human body firstly enters the sub-area e1, thereafter, exiting from the sub-area e1, entering the sub-area e2, finally exiting from the sub-area e2. When the human body enters the sub-area e1, the pyroelectric infrared detecting element 106*a* detects the infrared light, and changes the detecting signal to the positive level as shown in FIG. 2. Thereafter, the human body exits from the sub-area e1, and the pyroelectric infrared detecting element 106*a* recovers the detecting signal from the positive level to the ground level. The level detector compares the detecting signal with the positive threshold level. While the detecting signal is exceeding the positive threshold level, the level detector changes the object detecting signal to the positive high level. Thus, the level detector shapes the waveform, and produces the first pulse S1.

Subsequently, the human body enters the sub-area e2, and the pyroelectric infrared detecting element 106*b* changes the detecting signal to the negative level. When the human body exits from the sub-area e2, the pyroelectric infrared detecting element 106*b* recovers the detecting signal from the negative level to the ground level. The level detector also compares the detecting signal with the negative threshold level, and produces the second pulse S1. Thus, while the human body is crossing each of the detecting areas E1, E2, E3, E4 and E5, the signal processing unit 108 outputs two pulses S1 as the object detecting signal. The signal processing unit 108 supplies the object detecting signal S1 to the mode changer 105.

The mode changer 105 stores a reference time period T therein. The reference time period T is variable, and a watchman manually regulates the reference time period T to a certain value appropriate to the traveling velocity of an object. The mode changer 105 firstly determines a pulse interval t1/t2 of the object detecting signal S1, and compares the pulse interval t1/t2 with the reference time period T to see whether or not the pulse interval t1/t2 is longer than the reference time period T. The pulse interval t1 is longer than the reference time period T. Then, the mode changer 105 produces the mode signal S2 representative of a low-speed photographing work. On the other hand, the pulse interval t2 is shorter than the reference time period T. Then, the mode changer 105 produces another mode signal S3 representative of a high-speed photographing work.

The mode signal S2 or S3 is supplied to the camera controller 109, and the camera controller 109 instructs the monitor camera 101 to take pictures at long time intervals or at short time intervals. The monitor camera 101 takes the pictures of a low-speed moving object at the long time intervals and the pictures of a high-speed moving object at the short time intervals. The pieces of video data are transferred to the recording unit 102, and are stored in the non-volatile memory. The pieces of video data are read out from the non-volatile memory, and the image of the human body is produced on a display panel. Thus, the prior art monitoring system changes the photographing work between the high speed and the low speed depending upon the traveling speed of the moving object.

Another prior art tracking and monitoring system is disclosed in Japanese Patent Publication of Unexamined Application No. 11-258043. The second prior art tracking and monitoring system is hereinbelow described with reference to FIG. 3. The second prior art tracking and monitoring system is installed partially in a field and partially in a monitor room.

A camera unit is installed in the field, and includes an infrared industrial television camera 201, a pan head 202, a pair of electric motors 203*a*/203*b* and a motor driver 204. The infrared industrial television camera 201 is attached to the pan head 202, and the pan head 202 permits the infrared industrial television camera 201 to three-dimensionally change the attitude thereof. The electric motors 203*a*/203*b* are connected to a two-axis driving mechanism of the pan head 202, and the motor driver 204 is electrically connected to the electric motors 203*a*/203*b*. The motor driver 204 selectively energizes the electric motors 203*a*/203*b*, and the pan head 202 directs the infrared industrial television camera 201 to a desired direction. The infrared industrial television camera 201 detects infrared light radiated from a source of heat, and produces a video signal representative of the image in the field of view.

A monitoring apparatus is installed in the monitor room, and includes a signal processing unit 205, an image processing unit 206, a switch unit 207, a display unit 208 and a controller 209. The infrared industrial television camera 201 is connected to the signal processing unit 205, and supplies the video signal to the signal processing unit 205. The signal processing unit 205 is connected to the display unit 208 and the image processing unit 206, and processes the video signal. The signal processing unit 205 supplies an image-carrying signal to the display unit 208, and the display unit 208 reproduces the image in the field of view. A watchman checks the display unit 208 to see whether or not any invader enters the monitoring area of the second prior art tracking and monitoring system.

The signal processing unit 205 further supplies a video signal to the image processing unit 206. The image processing unit 206 forms a tracking loop together with the motor driver 204, the electric motors 203*a*/203*b*, the infrared industrial television camera 201 and the signal processing unit 205. The image processing unit 206 recognizes the image of the invader in the field of view, and determines the amount of offset between the image and the center of the field of view. The image processing unit 206 determines how to move the infrared industrial television camera 201 in order to decrease the amount of offset, and supplies a control signal through the switch unit 207 to the motor driver 204. The motor driver 204 selectively energizes the electric motors 203*a*/203*b* so as to cause the infrared industrial television camera 201 to track the invader.

When the watchman wants to manually control the infrared industrial television camera 201, the switch unit 207 is changed, and the controller 209 is electrically connected through the switch unit 207 to the motor driver 204. The watchman manipulates the controller 209, and the motor driver 204 causes the electric motors 203*a*/203*b* to direct the infrared industrial television camera 201 to a desired direction.

Problems are encountered in the first prior art monitoring system in grate price and in the adjustment of the time period T. Although the first prior art monitoring system is expected to monitor the wide monitoring area, the monitor camera 101 does not change the direction. The optical element 107 or the Fresnel lens widens the field angle θ, and is indispensable in so far as the monitor camera 101 is not accompanied with any three-dimensional driving mechanism.

Moreover, the first prior art monitoring system is expected to change the photographing work between the high speed and the low speed, and requires the signal processing unit 108 and the mode changer 105 for estimating the traveling speed. The signal processing unit 108 and the mode changer 105 are also indispensable from the viewpoint that the photographing work is to be changed between the high speed and the low speed. The Fresnel lens 107, the signal processing unit 108 and the mode changer 105 are expensive, and increase the price of the first prior art monitoring system.

The first prior art monitoring system is not designed for a particular invader. In other words, the traveling speed is unknown to the manufacturer. For this reason, the user needs to adjust the time period T to an appropriate value. The user is to determine the appropriate value in the trial and error fashion, and the adjustment of the time period T is complicated and time-consuming.

On the other hand, a problem inherent in the second prior art tracking and monitoring system is great price. The image processing unit 206 is expected to accurately determine the amount of offset between the image of the invader and the center of field of view. The accuracy is dependent on the integration density of the infrared detecting element array. Such a high density infrared detecting element array is expensive. Moreover, the image processing unit 206 runs on a huge complicated computer program for processing the video data, and a high-speed data processor is required for the execution of the huge complicated computer program. Such a huge complicated computer program and the high-speed data processor are expensive, and make the second prior art tracking and monitoring system great price.

SUMMARY OF THE INVENTION

It is therefore an important object of the present invention to provide a tracking and monitoring system, which is economical and improved in manipulability.

In accordance with an aspect of the present invention, there is provided a tracking and monitoring system comprising a heat source tracker producing a data signal representative of a current position of the heat source in a field of view and three-dimensionally changing the attitude thereof in such a manner as to catch an image of the heat source at a predetermined position in the field of view for tracking the heat source in a monitoring zone, a data processing system connected to the heat source tracker, checking the data signal to see whether or not the heat source enters a prohibited zone defined in the monitoring zone and producing an instruction for an alarm when the heat source enters the prohibited zone, and an alarm unit connected to the data processing system and responsive to the instruction for giving the alarm.

BRIEF DESCRIPTION OF THE DRAWINGS

The features and advantages of the tracking and monitoring system will be more clearly understood from the following description taken in conjunction with the accompanying drawings in which.

DESCRIPTION OF THE PREFERRED EMBODIMENTS

First Embodiment

Figure 1:
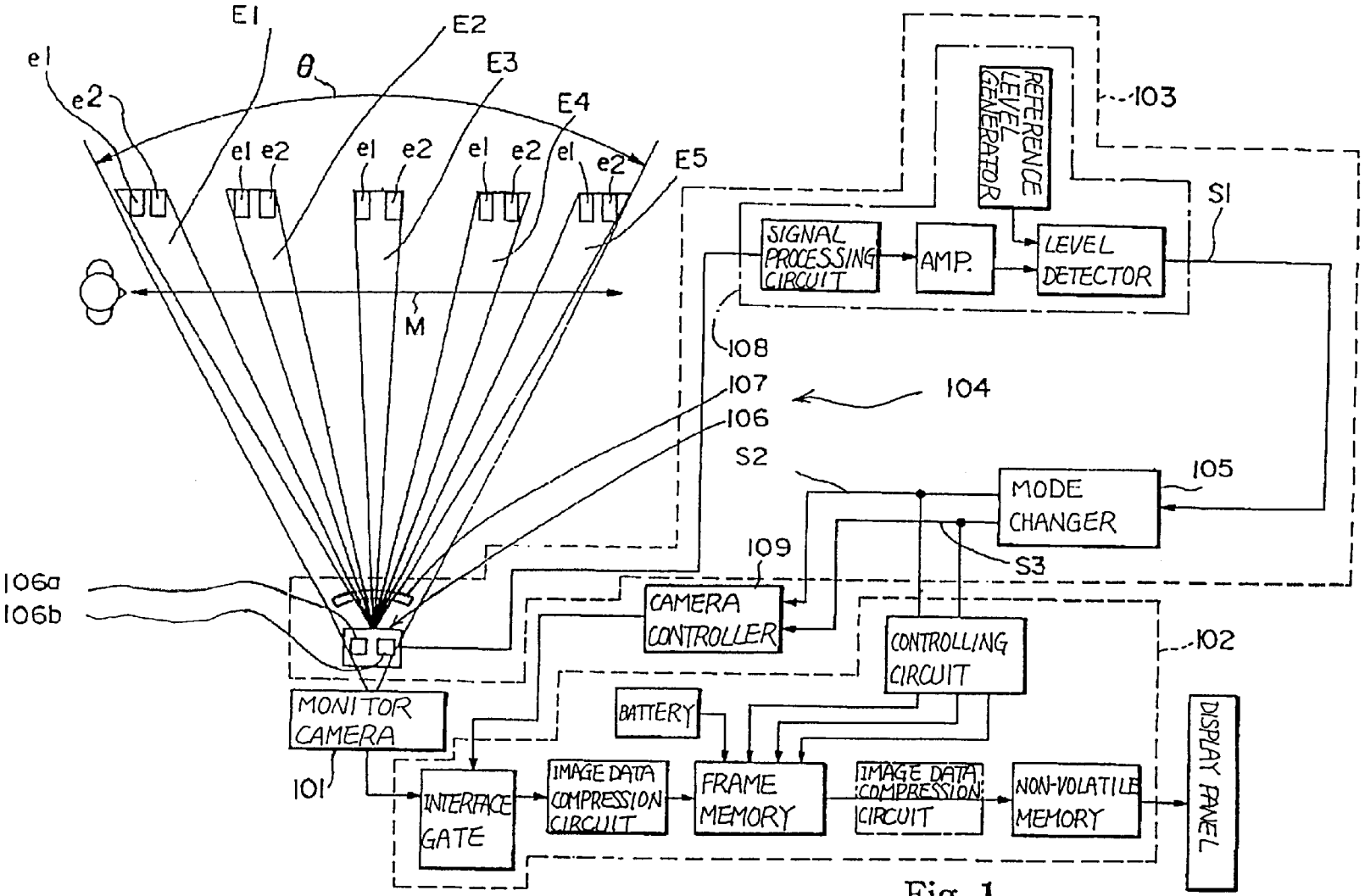
Fig. 1 PRIOR ART
FIG. 1 is a block diagram showing the scheme of the first prior art monitoring system.
Figure 2:
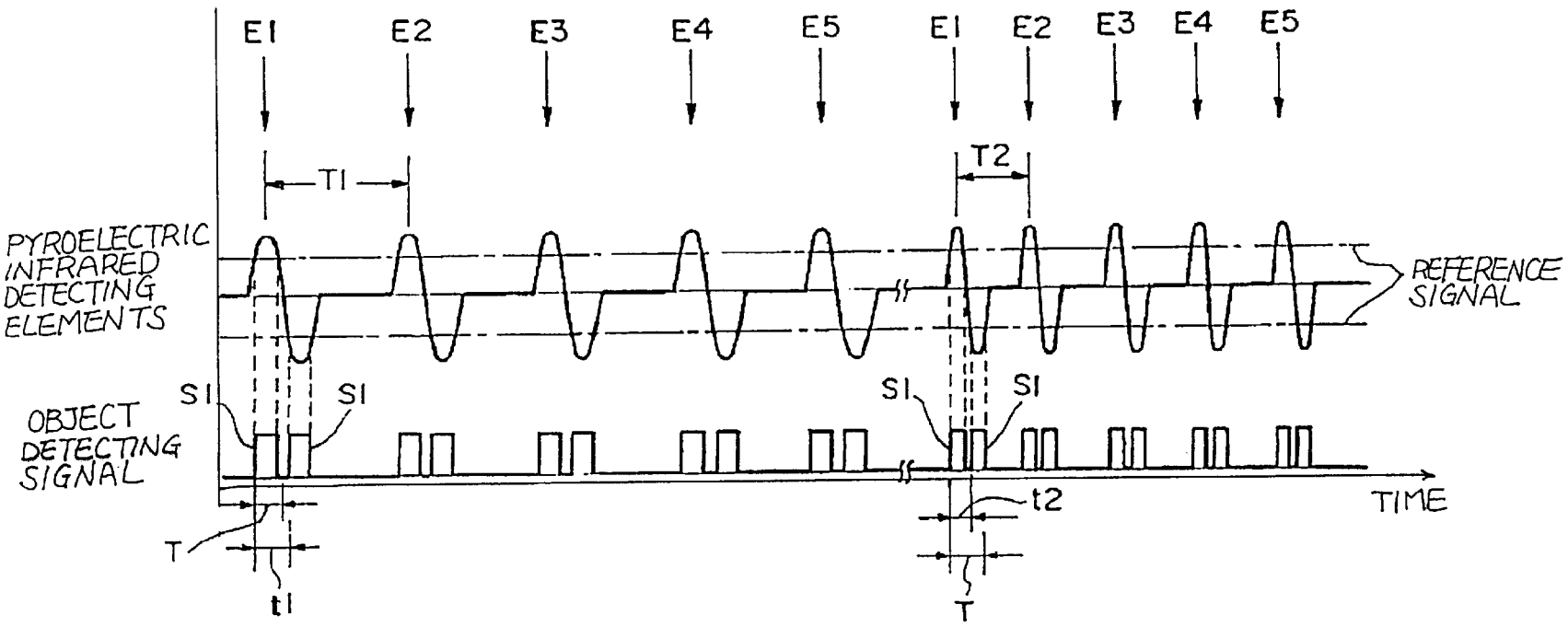
Fig. 2 PRIOR ART
FIG. 2 is a waveform diagram showing the object detecting signal produced in the prior art monitoring system.
Figure 3:
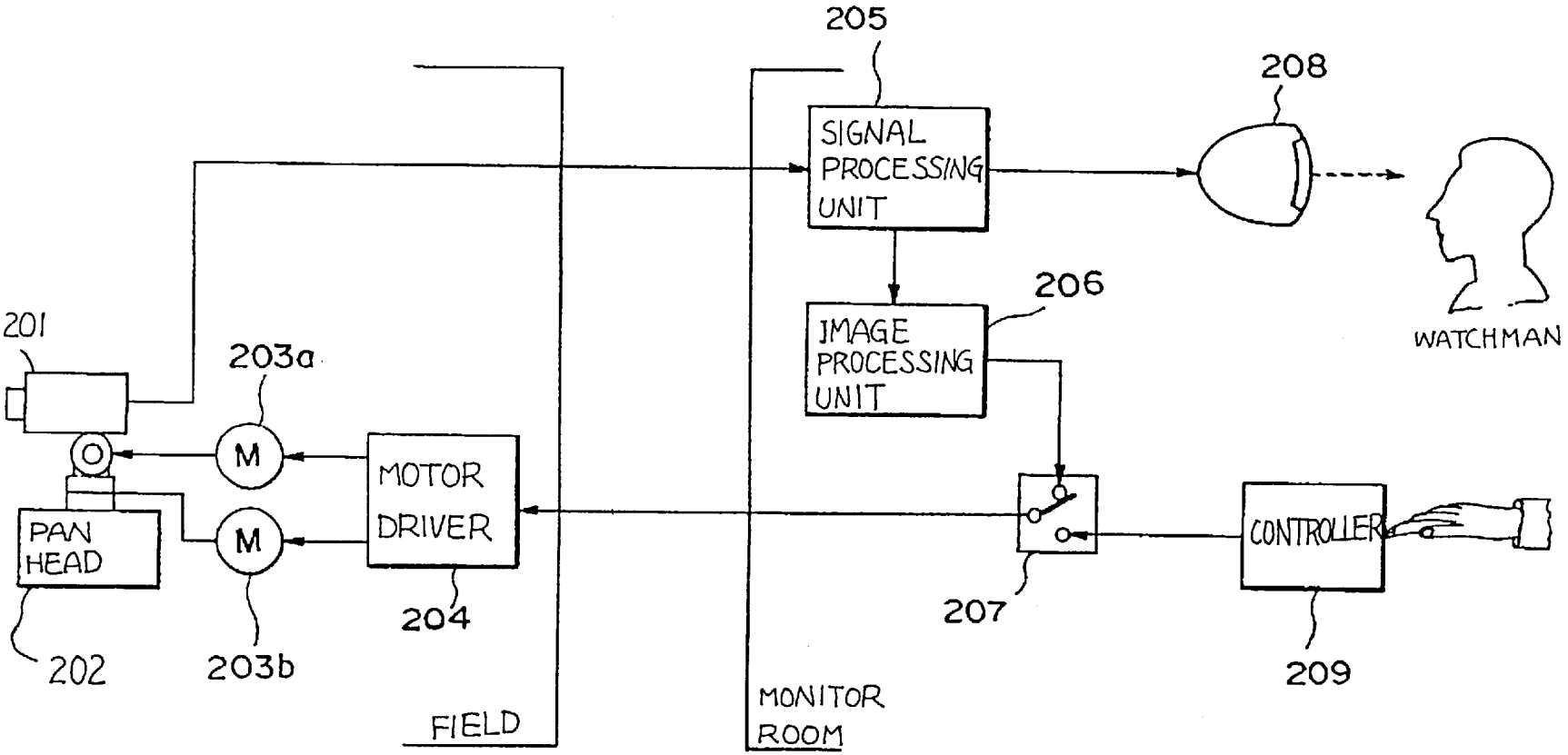
Fig. 3 PRIOR ART
FIG. 3 is a block diagram showing the scheme of the second prior art monitoring system.
Figure 4:
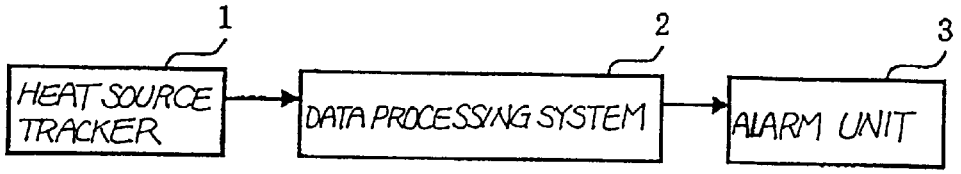
FIG. 4 is a block diagram showing the scheme of a tracking and monitoring system according to the present invention.

Referring to FIG. 4 of the drawings, a tracking and monitoring system embodying the present invention largely comprises a heat source tracker 1, a data processing system 2 and an alarm unit 3. The heat tracker 1 three-dimensionally varies the attitude, and automatically directs itself to a heat source or an invader radiating heat. A human body is an example of the heat source. While the heat source is moving in a detectable area, the heat source tracker 1 detects the heat source, and tracks the heat source. The heat source tracker 1 is connected to the data processing system 2, and supplies a data signal representative of the attitude to the data processing system 2. The data processing system 2 determines a prohibited area by itself on the basis of input data representative of an access gate through which an invader is to penetrate into the prohibited area. The data processing system 2 further determines a trajectory of the invader on the basis of the data signal, and checks the trajectory to see whether or not the invader enters the prohibited area. If the invader enters the prohibited area, the data processing system 2 supplies an alarm signal to the alarm unit 3. Then, the alarm unit 3 gives an alarm for the invader.

Figure 5:
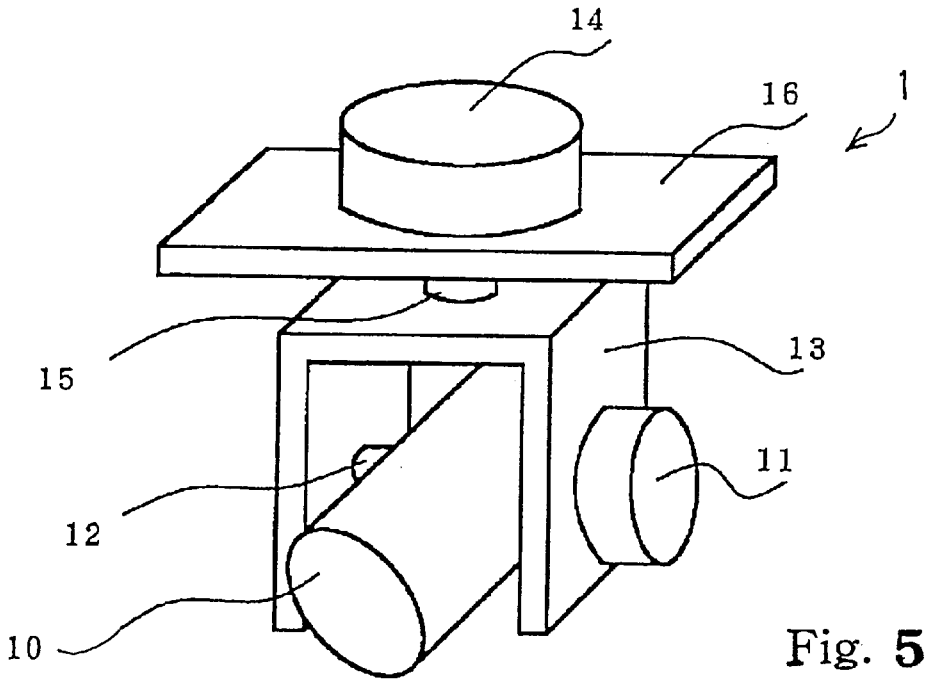
FIG. 5 is a perspective view showing the appearance of a heat source tracker incorporated in the tracking and monitoring system.

FIG. 5 illustrates the heat source tracker 1. The heat tracker 1 includes a heat detector 10, a servo-motor 11, a horizontal axis 12, a movable frame 13, a servo-motor 14, a vertical axis 15 and a stationary frame 16. These component parts 10 to 16 are assembled together as described hereinbelow.

A hollow space is defined in the movable frame 13. The horizontal axis 12 extends across the hollow space, and is rotatably supported by the movable frame 13. The servo-motor 11 is attached to the outer surface of the movable frame 13, and is connected to the horizontal axis 12. The heat detector 10 is fixed to the horizontal axis 12. The horizontal axis 12 is driven for rotation by the servo-motor 11, and the heat detector 10 is rotated around the horizontal axis 12 together. The direction of the heat detector 10 around the horizontal axis 12 is represented by angle θ around the horizontal axis 12 with respect to a reference direction.

The vertical axis 15 is rotatably supported by the stationary frame 16, and is connected at the lower end thereof to the movable frame 13 and at the upper end thereof to the servo-motor 14. The servo-motor 14 is attached to the stationary frame 16, and rotates the vertical axis 15 together with the movable frame 13 and the heat detector 10. The direction of the heat detector around the vertical axis 15 is represented by angle ϕ with respect to a reference direction. Thus, the heat detector 10 three-dimensionally changes the attitude, and the attitude is represented by the combination of angles (θ, ϕ).

Figure 6:
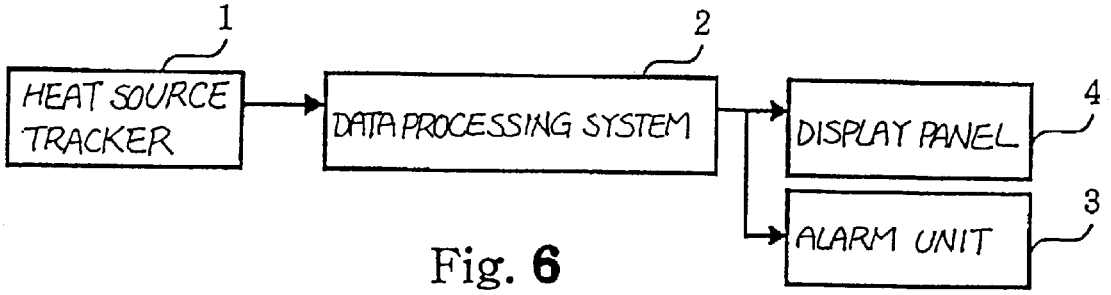
FIG. 6 is a block diagram showing a modification of the tracking and monitoring system according to the present invention.

The alarm unit 3 and a display panel 4 may be connected in parallel to the data processing system 2 as shown in FIG. 6. When an invader penetrates into the detectable area, the data processing system 2 supplies an image carrying signal representative of the trajectory of the invader to the display panel 4, and produces an image representative of the trajectory on the display panel 4. Of course, if the invader enters the prohibited area, the data processing system 2 supplies the alarm signal to the alarm unit 3, and the alarm unit 3 gives the alarm for the invader to a watchman.

The data processing system 2 may stores image data representative of an image of the field of view. In this instance, the image representative of the field of view is overlapped with the image representative of the trajectory so that the watchman easily finds the invader to be with a doubtful air.

Figure 7:
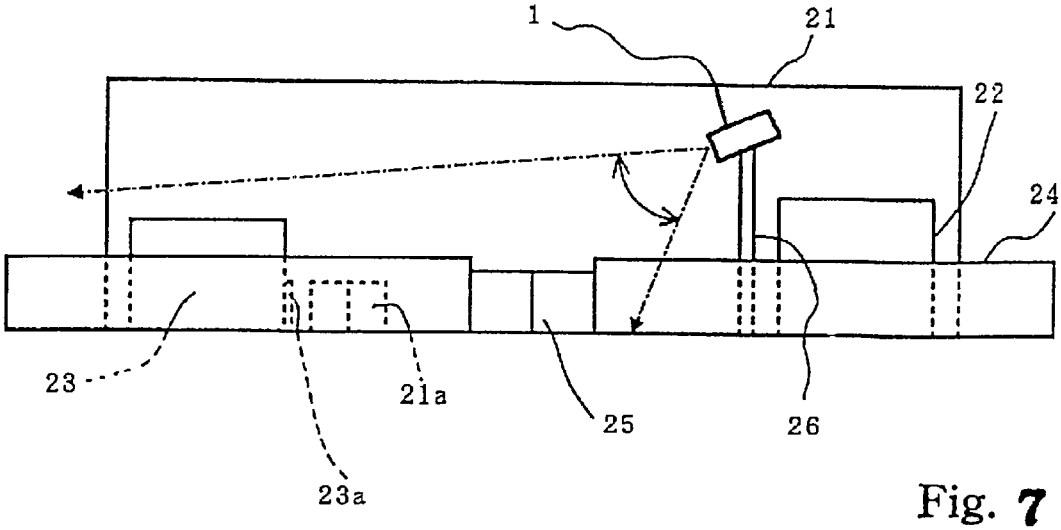
FIG. 7 is a schematic front view showing a manufacturing facility monitored by the tracking and monitoring system.
Figure 8:
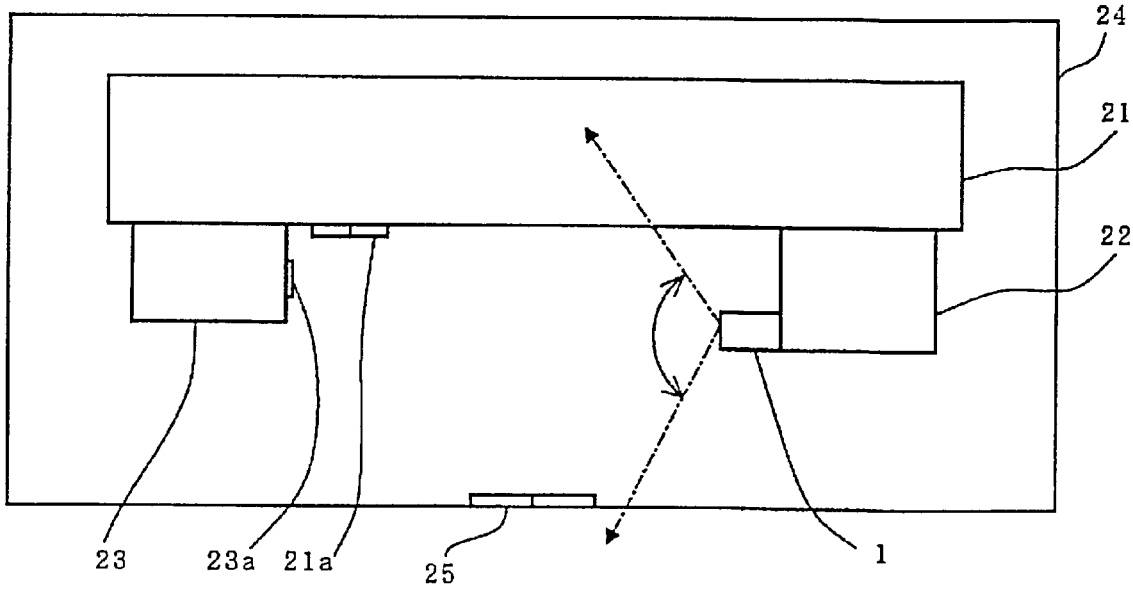
FIG. 8 is a plane view showing the arrangement of the manufacturing facility.

FIGS. 7 and 8 illustrate a manufacturing facility 21. Persons can enter the manufacturing facility 21 through a gate 21*a,* and a field office 22 and a storage house 23 for dangerous articles stand near the manufacturing facility. A gate 23*a* is provided in a wall of the storage house 23, and a front gate 25 is provided in the fence 24. The manufacturing facility 21, the field office 22 and the storage house 23 are guarded with a fence 24. A post 26 is upright from the ground inside the fence 24, and the heat source tracker 1 is attached to the leading end of the post 26. The heat source tracker 1 is movable at the maximum vertical angle θ and at the maximum horizontal angle ϕ. In other words, a monitoring zone is defined by the maximum vertical angle θ and the maximum horizontal angle ϕ. The front gate 25, the gates 23*a* and 21*a* and the front gate 25 are fallen in the monitoring range.

If a human being enters the area through the front gate 25, the heat source tracker 1 detects the infrared light, and starts the tracking. The heat source tracker 1 varies the direction in such a manner as to catch the invader at the center of the field of view.

Figure 9:
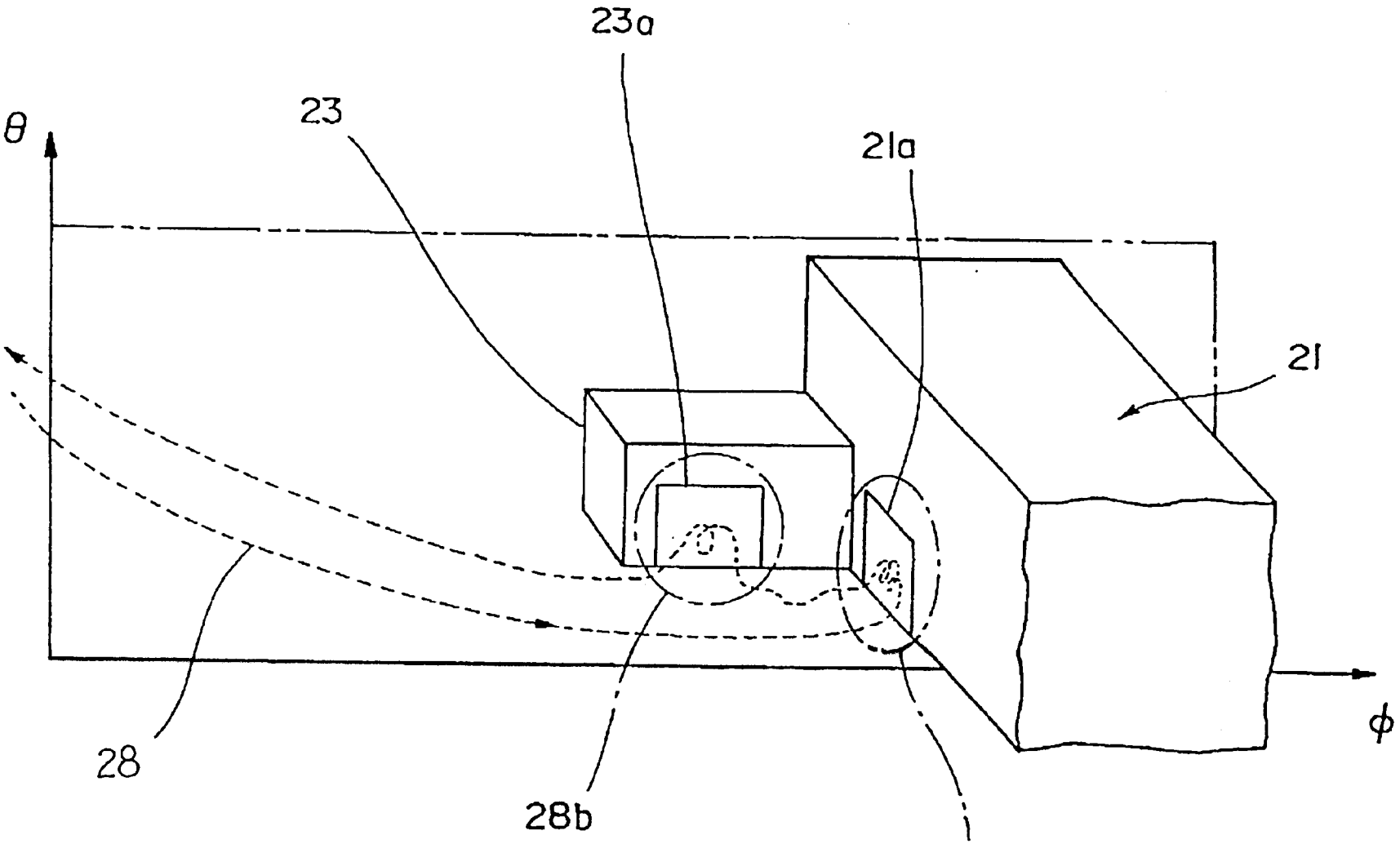
FIG. 9 is a schematic perspective view showing an invader penetrating into a monitoring zone.

The user is assumed to prohibit the gates 23*a* and 21*a* from invaders. The gates 23*a* and 21*a* are specified by the angles (θ1, ϕ1) and the angles (θ2, ϕ2), respectively. The user inputs the data representative of the two sets of angles (θ1, ϕ1) and (θ2, ϕ2) to the data processing system 2, and the data processing system 2 establishes the prohibited areas 28*a* and 28*b* in the monitoring zone (see FIG. 9). The invader enters the monitoring zone, approaches the gate 21*a* and, thereafter, the gate 23*a*, and, finally, exits from the monitoring zone. The trajectory of the invader is indicated by broken lines 28.

The heat source tracker 1 is directed to the invader, and keeps the image of the invader at the center of the field of view. While the invader is moving along the trajectory 28, the heat source tracker 1 varies the angles (θ, ϕ), and the data processing system 2 produces the image of trajectory 28 on the display panel 4 together with the image of the field of view. The invader enters the prohibited area 21*a* and, thereafter, the prohibited area 23*a*, and the data processing system 2 twice supplies the alarm signal to the alarm unit 3. The alarm unit 3 is responsive to the alarm signal, and gives the alarm for the invader to a watchman, twice. The alarm may be given through a sound source such as, for example, a siren.

Figure 10:
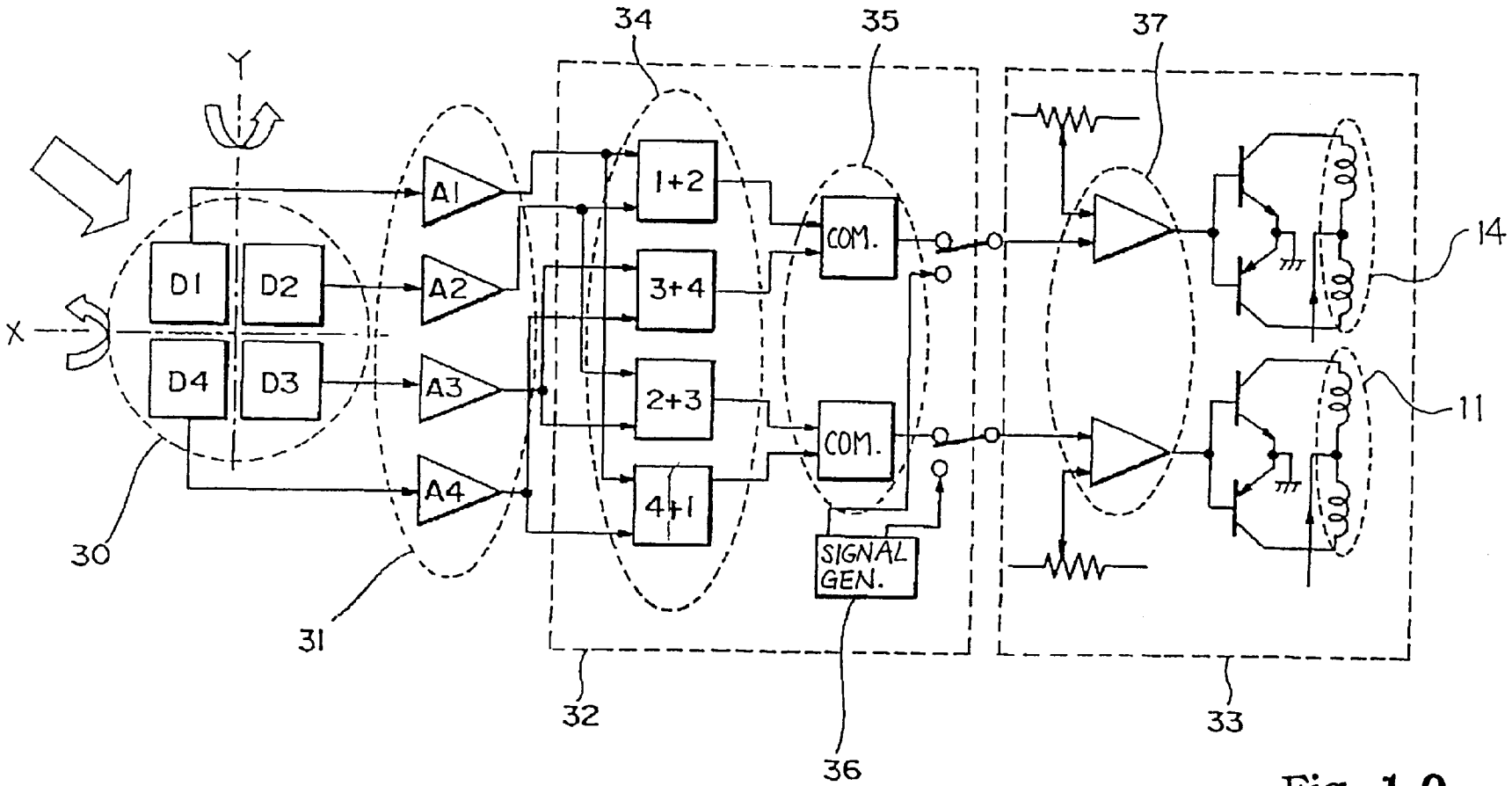
FIG. 10 is a circuit diagram showing a wired logic circuit incorporated in the heat source tracker.

FIG. 10 illustrates a wired logic circuit incorporated in the heat source tracker 1. The wired logic circuit is broken down into an infrared sensor 30, a low-noise amplifier 31, an automatic tracking controller 32, and a driving circuit 33. The infrared sensor 30 varies the magnitude of four detecting signals depending upon the position of a heat source in the field of view. When a heat source is positioned on the extension line of origin, i.e., crossing point between x-axis and y-axis, the four detecting signals are equal in magnitude to one another. However, if the heat source is offset from the extension line, the heat source makes the detecting signals unbalanced. The automatic tracking controller 32 determines the amount of offset on the basis of the unbalance among the detecting signals, and instructs the driving circuit 33 to minimize the offset. The basic technologies of the heat source tracker 1 are disclosed in Japanese Patent Publication of Unexamined Application No. 5-240938.

Two pairs of infrared detecting elements D1, D2, D3 and D4 are incorporated in the infrared sensor 30, and are sensitive to 2–14 micron wavelength infrared light at room temperature. A thermal detector such as, for example, a thermistor bolometer, a pyroelectric detector and a thermocouple and a quantum type detector such as, for example, a HgCdTe detector and an InSb detector are available for the infrared sensor 30. The infrared sensor 30 is sensitive to a heat source at relatively low temperature such as, for example, a human body and a heat source at relatively high temperature such as, for example, the exhaust gas from a vehicle.

The infrared detecting elements D1/D2 are arranged in symmetry with the other infrared detecting elements D3/D4 with respect to x-axis, and the infrared detecting elements D1/D4 are arranged in symmetry with the other infrared detecting elements D2/D3 with respect to y-axis. Infrared light is incident on the four infrared detecting elements D1 to D4, and the four infrared detecting elements D1 to D4 respectively produces the detecting signals. The magnitude of the detecting signals is dependent on the position of the heat source. The infrared detecting elements D1 to D4 supplies the detecting signals to the low-noise amplifier 31.

The low-noise amplifier 31 has four amplifiers A1, A2, A3 and A4, and the four infrared detecting elements D1 to D4 are respectively connected to the four amplifiers A1, A2, A3 and A4. The four amplifiers A1 to A4 appropriately increase the magnitude of the detecting signals, and supply the detecting signals to the automatic tracking controller 32.

The automatic tracking controller 32 includes four adders 34, two comparators 35, a signal generator 36 and two switch units. The detecting signals are selectively supplied to the four adders 34, and the adders 34 enhance the signal-to-noise ratio. The adder (1+2) adds the detecting signal from the infrared detecting element D1 to the detecting signal from the infrared detecting element D2. The adder (3+4) adds the detecting signal from the infrared detecting element D3 to the detecting signal from the infrared detecting element D4. The adder (2+3) adds the detecting signal from the infrared detecting element D2 to the detecting signal from the infrared detecting element D3. The adder (4+1) adds the detecting signal from the infrared detecting element D4 to the detecting signal from the infrared detecting element D1. The adders (1+2) and (3+4) supplies calculation signals representative of the sums to one of the comparators 35, and the other adders (2+3) and (4+1) supplies calculation signals representative of the sums to the other of the comparators 35.

When an invader enters into the monitoring zone, the signal generator 36 supplies switching signals to the switch units, and the switch units transfer control signals representative of the offset with respect to x-axis and the offset with respect to y-axis from the comparators 35 to the driving circuit 33. Thus, the heat source tracker 1 starts the tracking at the entry of an invader into the monitoring zone. However, the switching units selects the output signals of the signal generator before the entry into the monitoring zone, and the heat source tracker 1 searches the monitoring zone for an invader. While the heat source tracker is searching the monitoring zone for an invader, the driving circuit 33 supplies the driving signals to the servo-motors 11/14, and the servo-motors 11/14 moves the infrared sensor 30 around the monitoring zone. The heat source tracker 1 has two modes of operation, i.e., the search mode and the tracking mode. The alarm unit 3 may be deactivated in the search mode. On the other hand, while the heat source tracker 1 is operating in the tracking mode, the control signals are supplied from the comparators 35 to the data processing system 2, and the data processing system 2 determines the trajectory of the invader. When the invader enters the prohibited area, the data processing system 2 supplies the alarm signal to the alarm unit 3, and draws the attention of the watchman to the invader. If the display system 4 is connected to the data processing system 2, the data processing system 2 supplies the image carrying signal to the display panel 4, and produces the image representative of the trajectory of the invader.

The driving circuit 33 includes two servo-amplifiers 37 and two motor drivers connected to the servo-motors 14/11. The control signals are supplied to the servo-amplifiers 37, respectively, and the servo-amplifiers 37 supply servo-signals to the motor drivers, respectively. The motor drivers are responsive to the servo-signals. The servo driver determines the rotational angle and t he rotational direction on the basis of the absolute value and the polarization of the associated servo-signal. The servo-motors 14 and 11 independently change the movable bracket 13 and the heat detector 10 so as to minimize the offset from the extension line of the origin.

Figure 11:
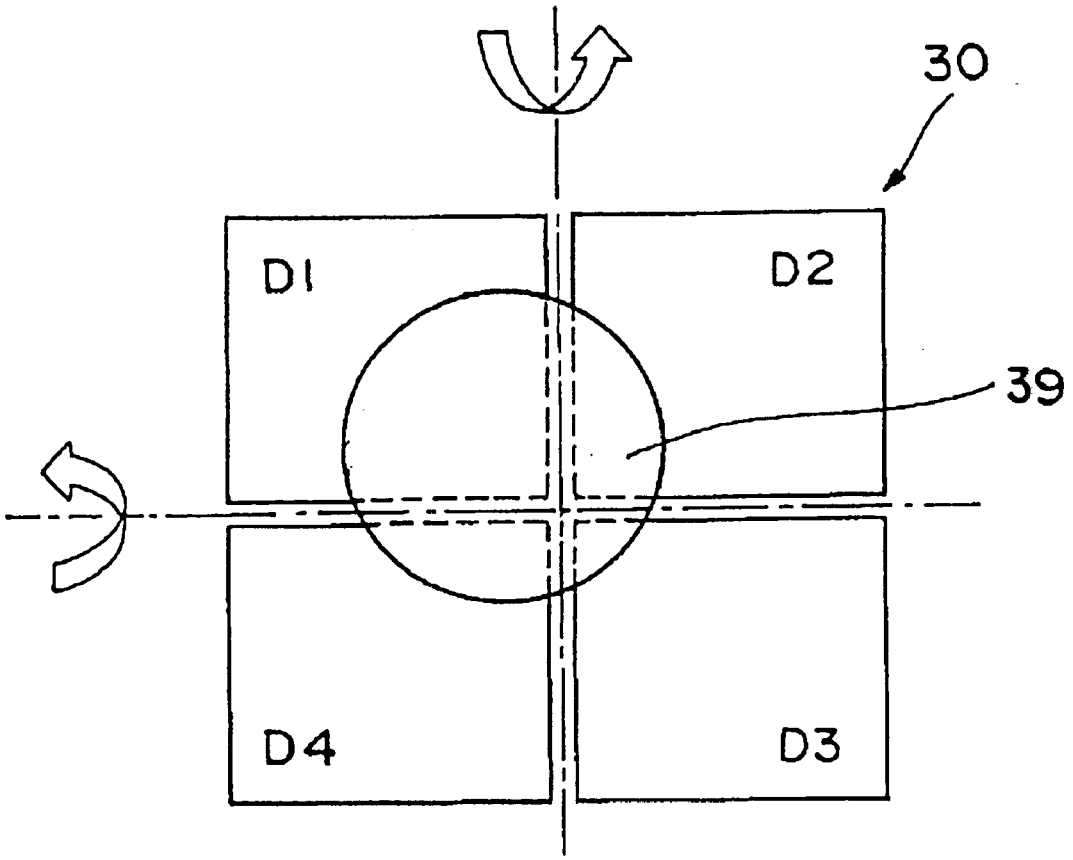
FIG. 11 is a view showing an image of a heat source in the field of view.

FIG. 11 shows an image 39 of a heat source in the field of view. The image of the invader is represented by a circle for the sake of simplicity. The heat source tracker 1 does not catch the invader at the center of the field of view, i.e., the origin between x-axis and y-axis. The invader is offset toward the upper edge of the left side. Although the infrared light from the invader is incident on the four infrared detecting elements D1/D2/D3/D4, the image occupies the infrared detecting element D1 widest, and the infrared detecting element D3 narrowest. The occupation area on the other infrared detecting elements D2/D4 is between the occupation area on the infrared detecting element D1 and the occupation area on the infrared detecting element D4. The detecting signals are different in magnitude from one another in proportional to the occupation areas. For this reason, the sum of the detecting signals from the infrared detecting elements D1 and D2 is greater than the sum of the detecting signals from the infrared detecting elements D3 and D4. Thus, the sums are unbalanced with respect to the x-axis. Similarly, the sum of the detecting signals from the infrared detecting elements D1 and D4 is greater than the sum of the detecting signals from the infrared detecting elements D2 and D3, and the sums are unbalanced with respect to the y-axis. The calculation results are represented by the calculation signals, and are compared by the comparators 35 for producing the control signals. The servo-amplifiers 37 and the motor drivers move the servo-motor 14/11 so as to cancel the offset.

As will be understood from the foregoing description, the tracking and monitoring system according to the present invention automatically establishes the prohibited areas in the monitoring zone on the basis of the pieces of data representative of the direction of the access port, and the use is released from the complicated adjustment.

Moreover, the tracking and monitoring system according to the present invention is equipped with the wired logic circuit, i.e., the automatic tracking control circuit 32 for tracking an invader. Any complicated computer program is not necessary for the wired logic circuit. Only four infrared detecting elements are required for the detection. For this reason, the manufacturer can reduces the production cost, and offers the tracking and monitoring system at low price.

Second Embodiment

Another tracking and monitoring system embodying the present invention also comprises a heat source tracker, a data processing system and an alarm unit. The data processing system and the alarm unit are similar to those of the first embodiment, and are not described hereinbelow for the sake of simplicity. The display panel 4 may be further incorporated in the tracking and monitoring system implementing the second embodiment.

Figure 12:
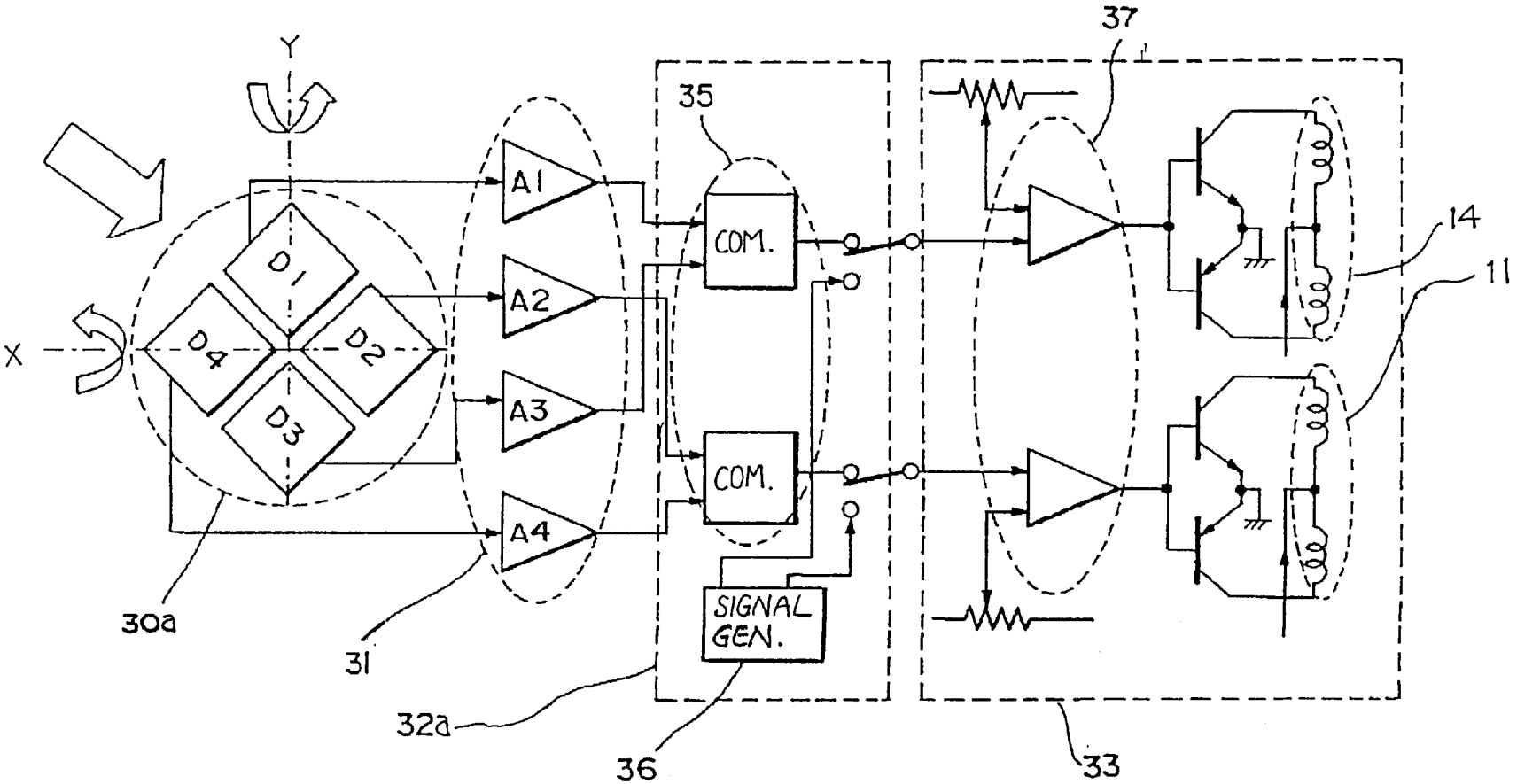
FIG. 12 is a circuit diagram showing a wired logic circuit of a heat source tracker incorporated in another tracking and monitoring system according to the present invention.

A wired logic circuit is incorporated in the heat source tracker, and is illustrated in FIG. 12. The heat source tracker comprises an infrared sensor 30*a*, a low-noise amplifier 31, an automatic tracking controller 32*a* and a driving circuit 33. The low-noise amplifier 31 and the driving circuit 33 are similar to those of the heat source tracker incorporated in the first embodiment. For this reason, description is focused on the infrared sensor 30*a* and the automatic tracking controller 32*a*.

Although the infrared sensor 30*a* is also implemented by four infrared detecting elements D1, D2, D3 and D4, the four infrared detecting elements D1 to D4 are arranged differently from those of the first embodiment. The infrared detecting elements of the heat source tracker 30*a* are rotated by 45 degrees, and are positioned on x-axis and y-axis. On the other hand, the automatic tracking controller 32*a* includes two comparators 35 and a signal generator 36, only.

The infrared detecting elements D1/D3 and D2/D4 are connected through the amplifiers A1/A3 and A2/A4 to the comparators 35. One of the comparators compares the detecting signal from the infrared detecting element D1 with the detecting signal from the infrared detecting element D3, and the other comparator compares the detecting signal from the infrared detecting element D2 with the detecting signal from the infrared detecting element D4. The comparators 35 produce a control signal representative of the offset in the direction of y-axis and a control signal representative of the offset in the direction of x-axis. The other circuit components behave as similar to those of the first embodiment.

The heat source tracker 1 of the second embodiment also have the monitor mode and the tracking mode. The behavior in those modes is similar to that of the first embodiment, and description is omitted for avoiding repetition.

As will be understood, the adders 34 are deleted from the heat source tracker 1 of the second embodiment. In other words, the tracking and monitoring system implementing the second embodiment is reduced in the number of parts, and, accordingly, the production cost is lower than that of the first embodiment.

Third Embodiment

Figure 13:
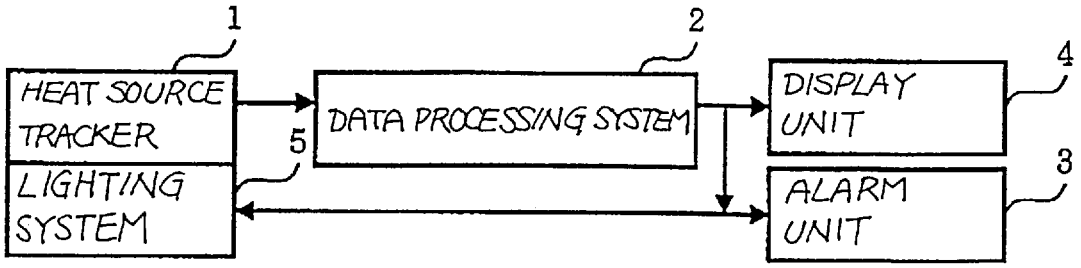
FIG. 13 is a block diagram showing the scheme of yet another tracking and monitoring system according to the present invention.

FIG. 13 illustrates yet another tracking and monitoring system embodying the present invention. The tracking and monitoring system largely comprises a heat source tracker 1, a data processing system 2, an alarm unit 3, a display unit 4 and a lighting system 5. The heat source tracker 1, the data processing system 2, the alarm unit 3 and the display unit 4 are similar to those of the first and second embodiment, and no further description is incorporated hereinbelow.

Figure 14:
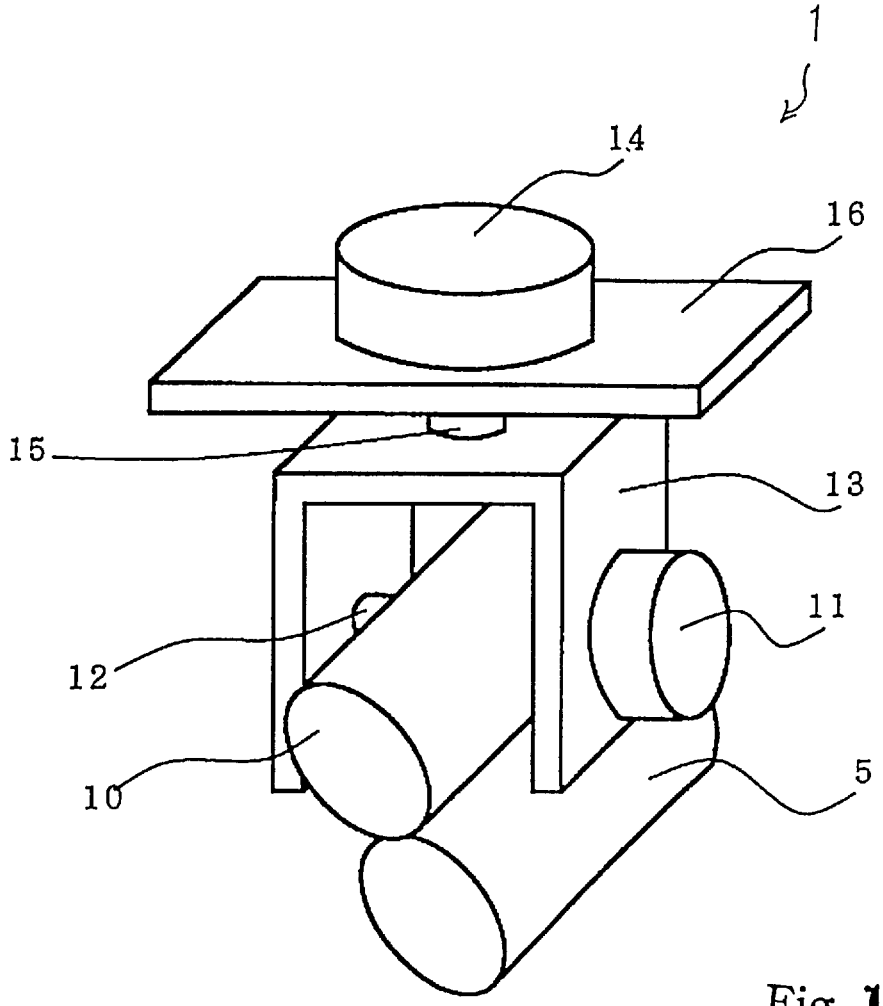
FIG. 14 is a schematic perspective view showing the appearance of a heat tracker incorporated in the tracking and monitoring system according to the present invention.

The lighting system 5 is attached to the heat detector 10 (see FIG. 14), and is moved together with the infrared sensor 30. The data processing system 2 instructs the lighting system 5 to radiate a visual light beam. The light beam is directed toward an invader. The tracking and monitoring system threatens the invader with the light beam, and a guard easily recognizes the invader at night. Even if the invader runs away, the automatic tracking controller 32 causes the servo-motors 11/14 to direct the infrared sensor 30 toward the invader, and, accordingly, the light beam goes run after the invader. Thus, the lighting system 5 continuously radiates the light beam toward the invader.

Assuming now an invader enters the monitoring zone, the heat source tracker 1 detects the infrared light radiated from the invader, and the tracking and monitoring system changes the search mode to the tracking mode. The heat source tracker 1 starts to track the invader, and supplies the control signals to the data processing system 2. The data processing system 2 stores the data representative of the angles ($\theta$, $\phi$) in an internal memory, and checks the data to see whether or not the invader enters the prohibited areas. If the invader enters the prohibited area, the data processing system 2 supplies the alarm signal to the alarm unit 3, and the alarm unit 3 gives the alarm for the invader to the watchman. Thereafter, the data processing system 2 instructs the lighting system 5 to illuminate the invader. Thus, the tracking and monitoring system firstly draws the attention to the invader, and, thereafter, radiates the light beam toward the invader. When the alarm unit 3 gives the alarm, a guard gets ready for going run after the invader. The guard starts, and the lighting system 5 radiates the invader.

The tracking and monitoring system implementing the third embodiment achieves all the advantages of the first embodiment. Moreover, the lighting system makes the guard clearly discriminate the invader even in dark.

Fourth Embodiment

Figure 15:
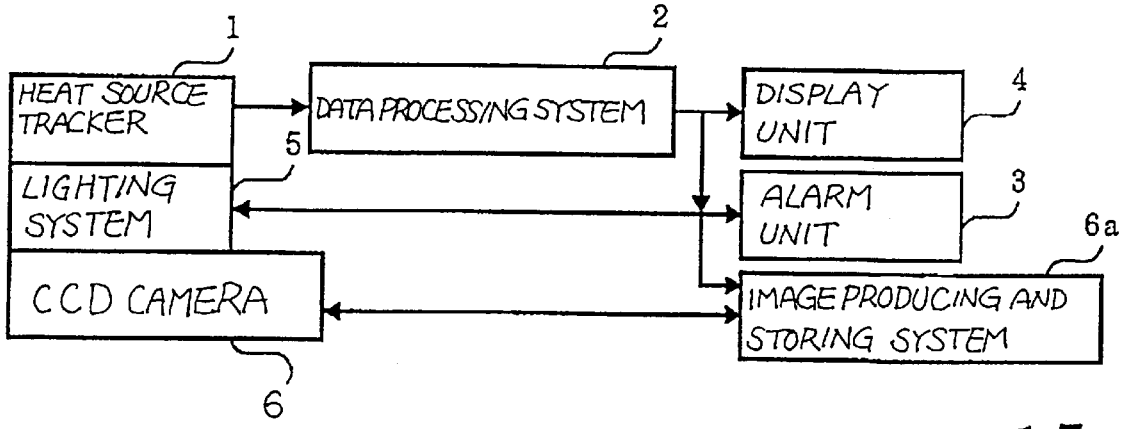
FIG. 15 is a block diagram showing the scheme of still another tracking and monitoring system according to the present invention.

FIG. 15 shows still another tracking and monitoring system embodying the present invention. The tracking and monitoring system largely comprises a heat source tracker 1, a data processing system 2, an alarm unit 3, a display unit 4, a lighting system 5, a CCD (Charge Coupled Device) camera 6 and an image producing and storing system 6*a*. The heat source tracker 1, the data processing system 2, the alarm unit 3, the display unit 4 and the lighting system 5 are similar to corresponding components in the first, second and third embodiments. For this reason, those components 1, 2, 3, 4 and 5 are not described hereinbelow for the sake of simplicity.

Figure 16:
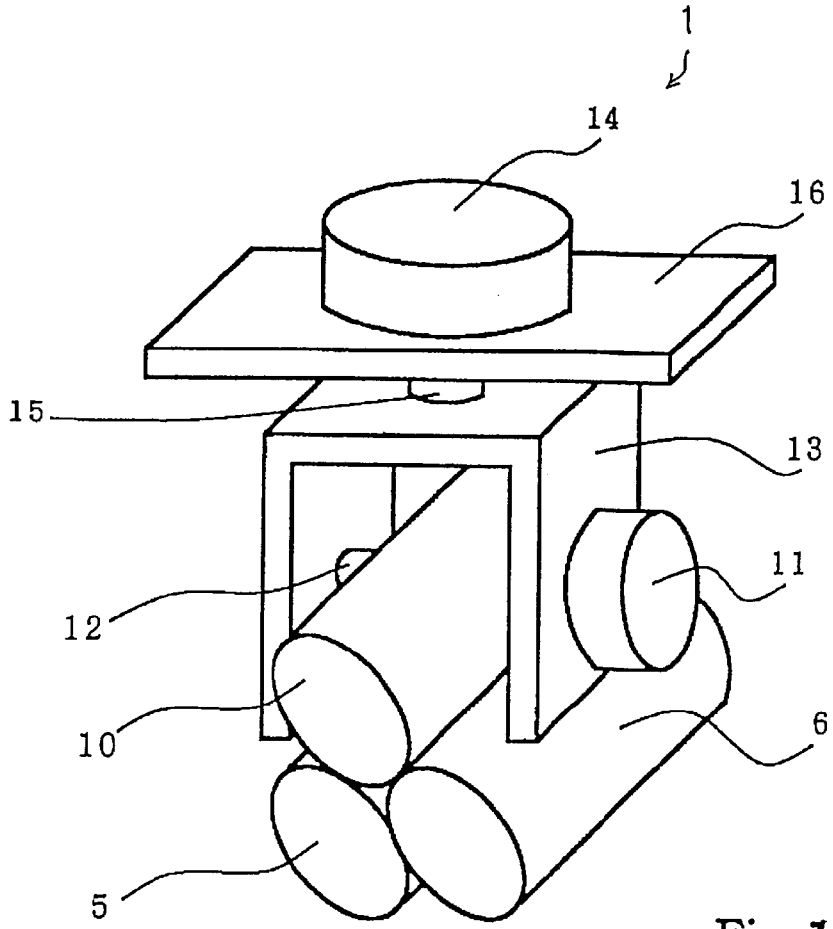
FIG. 16 is a schematic perspective view showing the appearance of a heat tracker incorporated in the tracking and monitoring system according to the present invention.

The CCD camera 6 is attached to the heat detector 10 (see FIG. 16), and is movable together with the heat detector 10. The CCD camera 6 is connected to the image producing and storing system 6*a*, and the image producing and storing system 6*a* controls the CCD camera 6. It is desirable that the resolution of the CCD camera 6 is large in value enough to recognize the looks of an invader.

When an invader enters the monitoring zone, the heat source tracker 1 changes the search mode to the tracking mode, and starts the tracking. While an invader is walking in the monitoring zone, the heat source tracker 1 continuously tracks the invader, and supplies the control signals representative of the angles ($\theta$, $\phi$) to the data processing system 2. If the invader enters the prohibited area, the data processing system 2 instructs the alarm unit 3 and the lighting system 5 to give the alarm and radiate the light beam as similar to the third embodiment. The data processing system 2 further instructs the image producing and storing system 6*a* to store an image of the invader. The image producing and storing system 6*a* instructs the CCD camera 6 to take pictures of the invader. The CCD camera 6 takes pictures of the invader, and supplies an image-carrying signal to the image producing and storing system 6*a*. The image data on the image-carrying signal is stored in an internal memory of the image producing and storing system 6*a*. A watchman reads out the image data from the internal memory, and checks the image to see whether or not the heat source is an invader with a doubtful air. If so, the pictures would be used in the crime detection. Even if the invader runs away, the heat source tracker 1 tracks the invader, and the lighting system 5 and the CCD camera 6 are directed to the invader. Thus, the tracking and monitoring system firstly gives the alarm. Thereafter, radiates the light beam to the invader, and takes the pictures of the invader.

As will be understood, the tracking and monitoring system implementing the fourth embodiment takes the pictures only when the invader enters the prohibited areas. The pictures are not many. For this reason, the watchman quickly looks for the target pictures from the internal memory. Of course, the tracking and monitoring system implementing the fourth embodiment achieves all the advantages of the first to third embodiments.

Fifth Embodiment

Figure 17:
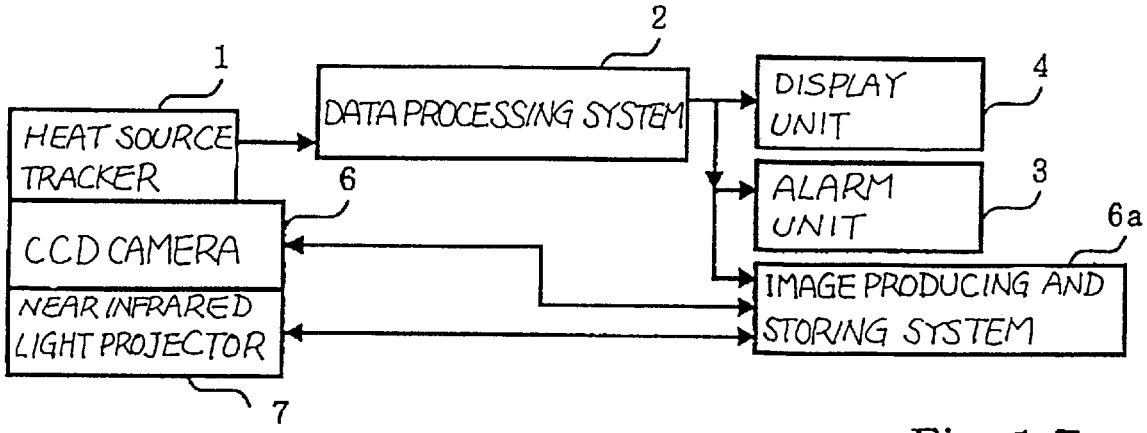
FIG. 17 is a block diagram showing the scheme of yet another tracking and monitoring system according to the present invention.
Figure 18:
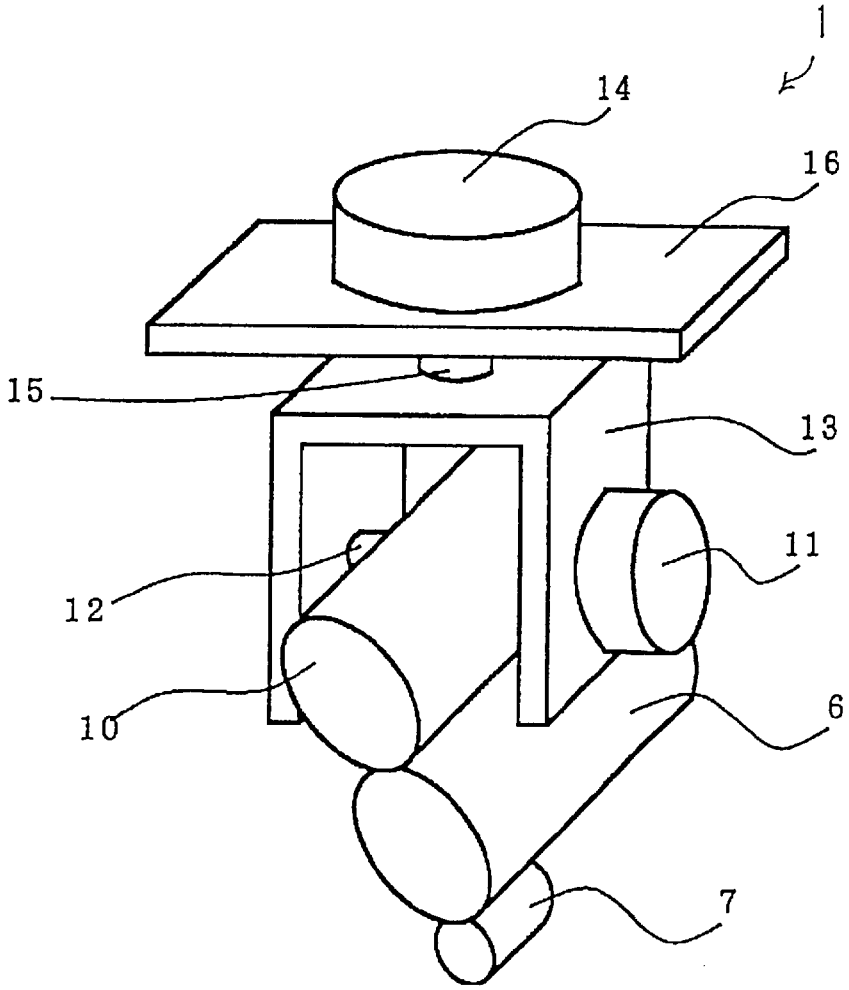
FIG. 18 is a schematic perspective view showing the appearance of a heat tracker incorporated in the tracking and monitoring system according to the present invention.

FIG. 17 shows yet another tracking and monitoring system embodying the present invention. The tracking and monitoring system largely comprises a heat source tracker 1, a data processing system 2, an alarm unit 3, a display unit 4, a CCD (Charge Coupled Device) camera 6, an image producing and storing system 6*a* and a near infrared light projector 7. The heat source tracker 1, the data processing system 2, the alarm unit 3, the display unit 4, the CCD camera and the image producing and storing system 6*a* are similar to corresponding components in the fourth embodiment. For this reason, those components 1, 2, 3, 4, 6 and 6*a* are not described hereinbelow for the sake of simplicity.

The lighting system 5 is replaced with the near infrared light projector 7, and the near infrared light projector 7 is controlled by the image producing and storing system 6*a* as similar to the CCD camera 6. When the image producing and storing system 6*a* instructs the CCD camera 6 to take pictures, the image producing and storing system 6*a* further instructs the near infrared light projector 7 to radiate near infrared light to the invader.

When an invader enters the monitoring zone, the heat source tracker 1 changes the search mode to the tracking mode, and starts the tracking. While an invader is walking in the monitoring zone, the heat source tracker 1 continuously tracks the invader, and supplies the control signals representative of the angles (θ, ϕ) to the data processing system 2. If the invader enters the prohibited area, the data processing system 2 instructs the alarm unit 3 to give the alarm and radiate. The data processing system 2 further instructs the image producing and storing system 6*a* to store an image of the invader. The image producing and storing system 6*a* instructs the near infrared light projector 7 to radiate the near infrared light to the invader, and further instructs the CCD camera 6 to take pictures of the invader. The near infrared light projector radiates the near infrared light to the invader, and the CCD camera 6 takes pictures of the invader. The CCD camera 6 supplies an image-carrying signal to the image producing and storing system 6*a*. The image data on the image-carrying signal is stored in an internal memory of the image producing and storing system 6*a*. A watchman reads out the image data from the internal memory, and checks the image to see whether or not the heat source is an invader with a doubtful air. If so, the pictures would be used in the crime detection. The invader does not notify that the near infrared light projector 7 illuminates him. For this reason, the CCD camera 6 takes pictures without being noticed.

As will be understood, the tracking and monitoring system implementing the fifth embodiment takes the pictures without being noticed. The pictures are not many. For this reason, the watchman quickly looks for the target pictures from the internal memory. Of course, the tracking and monitoring system implementing the fourth embodiment achieves all the advantages of the first to third embodiments.

Although particular embodiments of the present invention have been shown and described, it will be apparent to those skilled in the art that various changes and modifications may be made without departing from the spirit and scope of the present invention.

The lighting system may project the light beam toward the prohibited areas. The lighting system 5 may be separated from the heat source tracker 1. Similarly, the CCD camera may be separated from the heat source tracker 1. The CCD camera may be directed to the prohibited area. The lighting system 5 may be attached to the rotational axis 12 by means of a suitable attachment.

The lighting system may radiate the light beam before the alarm.

The CCD camera may take pictures of the prohibited areas.

The near infrared light projector may be built in the CCD camera 6.

What is claimed is:

1. A tracking and monitoring system comprising a heat source tracker producing a data signal representative of a current position of said heat source in a field of view and three-dimensionally changing the attitude thereof in such a manner as to catch an image of said heat source at a predetermined position in said field of view for tracking said heat source in a monitoring zone, a plurality of infrared detecting elements included in said heat source tracker and located in four quadrants defined in said field of view by two virtual axes perpendicular to each other to receive infrared light radiated from said heat source and to produce detecting signals each representative of the amount of infrared light incident on associated one of said plural infrared detecting elements, a data processing system connected to said heat source tracker, checking said data signal to see whether or not said heat source enters a prohibited zone defined in said monitoring zone and producing an instruction for an alarm when said heat source enters said prohibited zone, wherein said data processing system automatically determines said prohibited zone in accordance with data representative of a position of an access way through which said heat source enters said monitoring zone, and an alarm unit connected to said data processing system and responsive to said instruction for giving said alarm.

2. The tracking and monitoring system as set forth in claim 1, in which said data processing system selectively establishes a search mode and a tracking mode in said heat source tracker, said heat source tracker searches said monitoring zone for said heat source in said search mode while said data processing system does not find any heat source in said monitoring zone, and tracks said heat source in said tracking mode while said heat source is being moved in said monitoring zone.

3. The tracking and monitoring system as set forth in claim 1, in which said heat source tracker is sensitive to infrared light ranging from 2 micron wavelength to 14 micron wavelength.

4. The tracking and monitoring system as set forth in claim 1, further comprising:

a wired logic circuit connected to said plurality of infrared detecting elements and producing driving signals representative of said current position of said heat source offset from said predetermined position, and an actuator connected to said plural infrared detecting elements and responsive to said driving signals for changing said attitude thereof.

5. The tracking and monitoring system as set forth in claim 1, further comprising a display unit connected to said data processing system and responsive to said image-carrying signal representative of said trajectory of said heat source for producing an image of said trajectory.

6. The tracking and monitoring system as set forth in claim 5, in which said image-carrying signal further representative of a scene in said monitoring zone stored in said data processing system so that said display unit produces an image of said scene in such a manner as to overlap said image of said trajectory with said image of said scene.

7. The tracking and monitoring system as set forth in claim 1, further comprising a lighting system for radiating visual light.

8. The tracking and monitoring system as set forth in claim 7, in which said visual light is directed to said prohibited zone.

9. The tracking and monitoring system as set forth in claim 8, in which said data processing system instructs said lighting system to radiate said visual light to said prohibited zone when said heat source enters said prohibited zone.

10. The tracking and monitoring system as set forth in claim 9, in which said lighting system is attached to said heat source tracker so that said visual light goes run after said heat source after the entry into said prohibited zone.

11. The tracking and monitoring system as set forth in claim 1, further comprising a camera for taking pictures of said heat source and an image producing and storing system connected between said data processing system and said camera, responsive to an instruction supplied from said data processing unit for causing said camera to take pictures and storing pieces of image data representative of said pictures in a memory.

12. The tracking and monitoring system as set forth to claim 11, in which said data processing system instructs said image producing and storing system to take said pictures when said heat source enters said prohibited zone.

13. The tracking and monitoring system as set forth in claim 12, in which said camera is attached to said heat source tracker so that said camera is directed to said heat source after the entry into said prohibited zone.

14. The tracking and monitoring system as set forth in claim 12, in which the resolution of said camera is so high that looks of said heat source is discriminative from said pictures.

15. The tracking and monitoring system as set forth in claim 11, further comprising an infrared light projector connected to said image producing and storing system for projecting infrared light toward said heat source when said camera takes said pictures.

16. The tracking and monitoring system as set forth in claim 15, in which said infrared light projector and said camera are attached to said heat source tracker.

17. A tracking and monitoring system comprising:

a heat source tracker producing a data signal representative of a current position of said heat source in a field of view and three-dimensionally changing the attitude thereof in such a manner as to catch an image of said heat source at a predetermined position in said field of view for tracking said heat source in a monitoring zone, a data processing system connected to said heat source tracker, checking said data signal to see whether or not said heat source enters a prohibited zone defined in said monitoring zone and producing an instruction for an alarm when said heat source enters said prohibited zone, said data processing system determining a trajectory path of said heat source and producing an image-carrying signal representative of said heat source, and an alarm unit connected to said data processing system and responsive to said instruction for giving said alarm, wherein said heat source tracker has plural infrared detecting elements receiving infrared light radiated from said heat source and producing detecting signals each representative of the amount of infrared light incident on associated one of said plural infrared detecting elements, a wired logic circuit connected to said plural infrared detecting elements and producing driving signals representative of said current position of said heat source offset from said predetermined position, and an actuator connected to said plural infrared detecting elements and responsive to said driving signals for changing said attitude thereof, and wherein said plural infrared detecting elements are located in four quadrants defined in said field of view by two virtual axes perpendicular to each other, and said wired logic circuit compares the detecting signals supplied from the infrared detecting elements on one side of one of said virtual axes with the detecting signals supplied from the infrared detecting elements on the other side of said one of said virtual axes for producing one of said driving signals representative of an offset from said one of said virtual axes, and the detecting signals supplied from the infrared detecting elements on one side of the other of said virtual axes with the detecting signals supplied from the infrared detecting elements on the other side of said other of said virtual axes for producing the other of said driving signals representative of an offset from said other of said virtual axes.

18. The tracking and monitoring system as set forth in claim 17, in which said wired logic circuit includes a first comparator supplied with said detecting signals for producing said one of said driving signals and a second comparator supplied with said detecting signals for producing said other of said driving signals.

19. The tracking and monitoring system as set forth in claim 17, in which said wired logic circuit further includes plural adders connected between said plural infrared detecting elements and said first and second comparators, and selectively supplied with said detecting signals for eliminating a noise component from said detecting signals.

20. A tracking and monitoring system comprising:

a heat source tracker producing a data signal representative of a current position of said heat source in a field of view and three-dimensionally changing the attitude thereof in such a manner as to catch an image of said heat source at a predetermined position in said field of view for tracking said heat source in a monitoring zone, a data processing system connected to said heat source tracker, checking said data signal to see whether or not said heat source enters a prohibited zone defined in said monitoring zone and producing an instruction for an alarm when said heat source enters said prohibited zone, and an alarm unit connected to said data processing system and responsive to said instruction for giving said alarm, wherein said heat source tracker has plural infrared detecting elements receiving infrared light radiated from said heat source and producing detecting signals each representative of the amount of infrared light incident on associated one of said plural infrared detecting elements, a wired logic circuit connected to said plural infrared detecting elements and producing driving signals representative of said current position of said heat source offset from said predetermined position, and an actuator connected to said plural infrared detecting elements and responsive to said driving signals for changing said attitude thereof, and wherein said plural infrared detecting elements are located on four virtual lines extending from said predetermined position at intervals of 90 degrees, and said wired logic circuit compares the detecting signals supplied from the infrared detecting elements on the two virtual lines aligned with each other for producing one of said driving signals representative of an offset from the other virtual lines perpendicular to said two virtual lines, and the detecting signals supplied from the infrared detecting elements on said other virtual lines for producing the other of said driving signals representative of an offset from said two virtual lines.

21. The tracking and monitoring system of claim 20, further comprising:

a first comparator having a first input and a second input, said first input and said second input of said first comparator being amplified signals from a portion of said plural infrared detecting elements positioned on a vertical axis; and a second comparator having a first input and a second input, said first input and said second input of said second comparator being amplified signals from another portion of said plural infrared detecting elements positioned on a horizontal axis.

* * * * *